US006412415B1

(12) United States Patent
Kothari et al.

(10) Patent No.: US 6,412,415 B1
(45) Date of Patent: Jul. 2, 2002

(54) SHOCK AND VIBRATION PROTECTION FOR TOOLS CONTAINING EXPLOSIVE COMPONENTS

(75) Inventors: Manish Kothari, Stafford; Larry J. Bernard, Missouri City, both of TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/434,412

(22) Filed: Nov. 4, 1999

(51) Int. Cl.[7] ..... F42B 3/00; F42D 3/00

(52) U.S. Cl. ..... 102/313; 102/312; 102/331; 102/332; 166/297

(58) Field of Search ..... 162/312, 313, 162/331, 332, 333; 166/297, 292.2

(56) References Cited

U.S. PATENT DOCUMENTS 3,191,678 A * 6/1965 Hinson ..... 166/36
3,234,723 A * 2/1966 Brown ..... 57/149
3,572,245 A * 3/1971 Grayson ..... 102/20
4,693,317 A 9/1987 Edwards et al. ..... 166/378
4,699,060 A * 10/1987 Vuillaume ..... 102/312 X
5,161,616 A 11/1992 Colla ..... 166/297
5,188,191 A 2/1993 Tomek ..... 175/321
5,375,528 A * 12/1994 Brinkman et al. ..... 102/332 X
5,964,294 A 10/1999 Edwards et al. ..... 166/297
6,070,663 A * 6/2000 Cernocky et al. ..... 166/272.3
6,170,400 B1 * 1/2001 Salort

FOREIGN PATENT DOCUMENTS

GB 2 277 762 A 11/1994

* cited by examiner

*Primary Examiner*—Peter A. Nelson
(74) *Attorney, Agent, or Firm*—Trop, Pruner & Hu PC

(57) ABSTRACT

A method and apparatus for use in a wellbore includes explosive components, a housing containing the explosive components, and at least one protection barrier mounted on the housing to reduce transmissibility of an external force load to the housing. The explosive components array include shaped charges and detonating cords for use in perforating guns.

23 Claims, 3 Drawing Sheets

SHOCK AND VIBRATION PROTECTION FOR TOOLS CONTAINING EXPLOSIVE COMPONENTS

BACKGROUND

The invention relates to shock and vibration protection for tools containing explosive components, such as shaped charges in perforating guns.

One operation that is performed in completing a well is the creation of perforations in a formation. This is typically done by lowering a perforating gun string to a desired depth in a wellbore and activating the gun string to fire shaped charges. The shaped charges when fired create perforating jets that form holes in any surrounding casing as well as extend perforations into the surrounding formation.

Various types of perforating guns exist. One type of perforating gun includes capsule shaped charges that are mounted on a strip in various patterns. The capsule shaped charges are protected by individual containers or capsules from the harsh wellbore environment. Another type of perforating gun includes non-capsule shaped charges, which are loaded into a sealed carrier for protection. Such perforating guns are sometimes also referred to as hollow carrier guns. The non-capsule shaped charges of such hollow carrier guns may be mounted in a loading tube that is contained inside the carrier, with each shaped charge connected to a detonating cord. When activated, a detonation wave is initiated in the detonating cord to fire the shaped charges. In a hollow-carrier gun, charges shoot through the carrier into the surrounding casing formation.

After a perforating gun is assembled, it is transported to the well site, which may be at some remote location. During handling, the perforating gun may be subjected to shock, such as due to accidental drops. Also, as the perforating gun is being transported, such as in a truck or a boat, the perforating gun may continue to be subjected to shock and vibration. After the perforating gun reaches the well site, it is subjected to further handling to prepare it for lowering into the wellbore. Once it is inserted into the wellbore, the perforating gun is typically run thousands of feet into the wellbore. During run in, the perforating gun may collide with other downhole equipment, such as production tubing or casing, or with the wall of the wellbore, which subjects the gun to further shock.

The various shock and vibration loads that are applied to the perforating guns may damage the components inside the guns, including the shaped charges and detonating cords. Referring to FIG. 1, a shaped charge 210 typically includes a main explosive charge 216 and a metallic liner 220, both contained in an outer case 212. A primer charge 214 coupled to the back of the main explosive is typically connected to a detonating cord 224. A detonation wave traveling down the detonating cord 224 transfers energy to the primer charge 214, which in turn initiates the main explosive 216. Detonation of the main explosive 216 causes the liner to collapse to form the perforating jet.

If the shaped charge 210 is subjected to relatively high levels of shock and vibration loads, the liner 220 may crack or fall out of the case 212. Further, the shaped charge case 212 may become deformed by the shock and vibration loads. The detonating cord 224 may also be flattened or severed. Such damage to the shaped charges or detonating cord may cause a perforating gun to fail. When a perforating gun is lowered to a desired depth but for some reason cannot be activated, a mis-run has occurred. This requires that the perforating gun string to be pulled out of the wellbore and replaced with a new gun string, which is time consuming and expensive. Also, retrieving a mis-fired gun from a well is a hazardous operation.

Thus, a need exists for a method and apparatus to protect perforating guns and other types of downhole tools from shock and vibration.

SUMMARY

In general, in one embodiment, an apparatus for use in a wellbore includes an explosive device, a housing for the explosive device, and at least one protection barrier for the housing to reduce transmission of an external force load to the housing.

Other embodiments and features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

Figure 1:
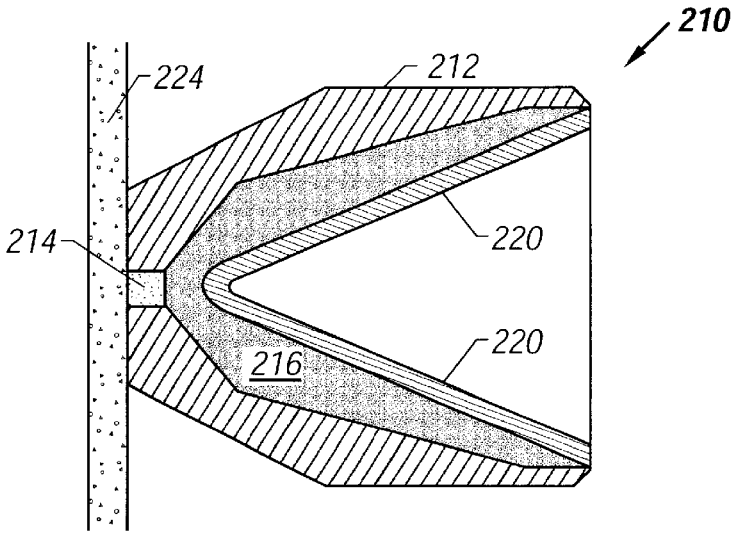
FIG. 1 (Prior Art)
FIG. 1 illustrates a conventional shaped charge.
Figure 2:
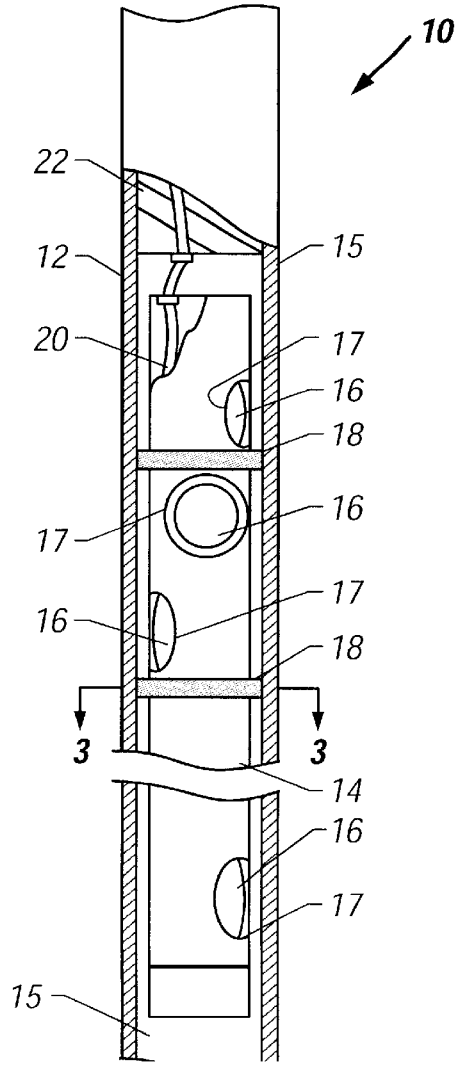
FIG. 2 illustrates a perforating gun in accordance with one embodiment.

Referring to FIG. 2, a hollow carrier perforating gun 10 includes a carrier 12 that has an inner chamber 15 to contain a loading tube 14, which provides a housing for explosive components of the perforating gun 10. The carrier 12 is sealed to protect components inside the carrier. The loading tube 14 includes a number of openings 17 in which shaped charges 16 may be mounted. In the illustrated embodiment, the loading tube 14 includes shaped charges 16 arranged in a spiral arrangement to perforate in a plurality of directions.

A detonating cord 20 extends through an upper bulkhead 22 of the gun carrier 12 and an upper portion of the carrier chamber 15 to the loading tube 14. The detonating cord 20 is passed into the loading tube 14 for connection to the shaped charges 16.

In accordance with some embodiments, one or more protection bands 18 may be mounted along the loading tube 14 at one or more predetermined locations to protect the loading tube 14 and components inside the loading tube against shock and vibration experienced by the carrier 12 during handling, transportation, and running into a wellbore. Each protection band 18 may generally include a ring formed of any type of material capable of absorbing shock or vibration, such as elastomer, Teflon, cloth, foam, fibreglass, or other types of materials. Alternatively, each protection band 18 may be a generally circular tube containing some type of a gel that provides shock and vibration absorbing characteristics. The protection barriers 18 may each be formed of a resilient and deformable material.

Figure 4:
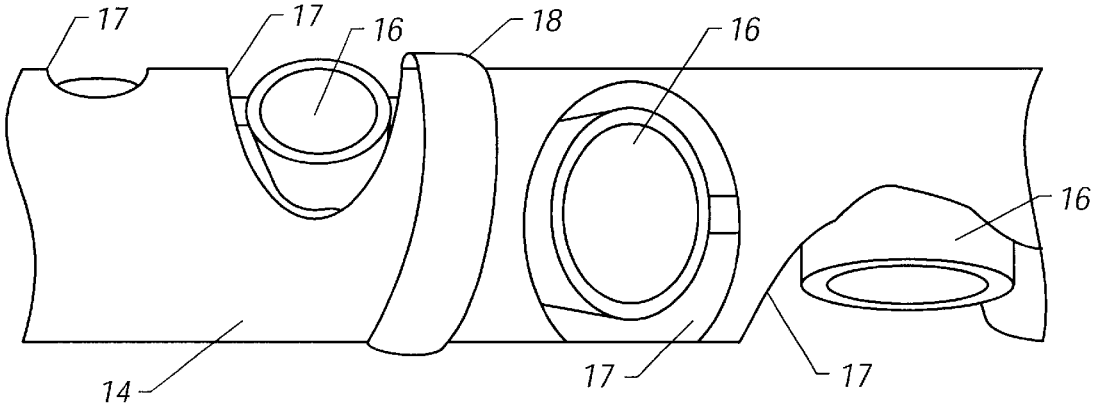
FIG. 4 illustrates a protection band mounted on a loading tube of the perforating gun of FIG. 2 in accordance with one embodiment.

As illustrated in FIG. 4, each protection band 18 extends around the circumference of a portion of the loading tube 14. In other embodiments, other forms of protection barriers may be employed. For example, the protection barriers may be pieces that are square, rectangular, round, or of some other shapes. Such pieces may be attached to the loading tube by an adhesive or other mounting mechanism. Thus, protection barriers may be of various forms and may be mounted on the loading tube by various different mechanisms.

Two types of external force loads that can be applied to a perforating gun includes shock and vibration loads. As used here, the term "external force load" refers to a load applied against the performing gun by external forces, such as shock (due to sudden impact with another object) or vibration (which is generally continuous in nature).

Generally, shock loads are applied for only a relatively small period of time, while vibration loads are more continuous and are applied for some duration of time. Shock and vibration loads may be quantified by acceleration (g-level), frequency (Hz), and duration (seconds).

Shock and vibration loads experienced by the gun carrier 12 are transmitted to the loading tube 14. If the clearance between the loading tube 14 and a carrier 12 is large, and the loading tube 14 is supported only at one or two locations, the shock and vibration survivability of the perforating gun is greatly reduced. If the loading tube 14 is not well supported, the shock and vibration transmissibility is relatively high. Collision between the loading tube 14 and the carrier 12 causes high shock and vibration loads to be experienced by the loading tube 14 and components in the loading tube. Example shock and vibration transmissibility may range between two and four. Thus, any shock or vibration load experienced by the carrier 12 is enhanced by a factor of two to four when transferred to the loading tube 14 and components (e.g., shaped charges 16 and detonator 20) mounted in the loading tube. As a result, the shaped charges 16 and detonating cord 20 held in the loading tube 14 may be propelled towards the carrier at a relatively high acceleration due to a shock load, or the shaped charges and detonating cord 20 may be continuously propelled towards and away from the carrier with high acceleration due to a vibration load. The acceleration levels experienced by the shaped charges 16 and detonating cord 20 can be very high and can result in damage to the shaped charges (including liners, cases, and explosive pellets) or to the detonating cord attached to the shaped charges.

Figure 3:
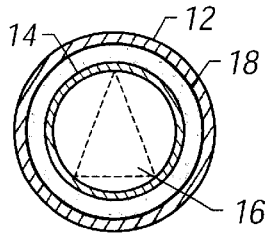
FIG. 3 is a cross-sectional view of a portion of the perforating gun of FIG. 2.

By employing the protection bands 18 in accordance with some embodiments, the shock and vibration load transmissibility between the gun carrier 12 and the loading tube 14 may be substantially reduced. Note that the gun carrier 12 is distinct from a casing lining the wellbore, such as casing 100 shown in FIG. 5. The protection bands 18 provide a centralized support that prevents the loading tube 14 from colliding from with the carrier housing 12. Each protection band 18 is resilient and deforms to absorb the shock and vibration loads. In one example embodiment, a plurality of protection bands 18 may be attached to the loading tube at 18-inch to 24-inch intervals. Use of protection bands 18 effectively reduces the clearance between the loading tube 14 and the carrier 12 as illustrated in FIG. 3.

In addition to reducing transmissibility of shock and vibration loads, the protection bands 18 also increase the resonant frequency of the loading tube 14 and the components in the loading tube. When the loading tube 14 vibrates at a frequency within its resonant frequency range, the transmissibility of the shock and vibration loads may be increased. In one example configuration, the resonant frequency range of the loading tube 14 may be between 20 Hz and 30 Hz, and the resonant frequency range of the shaped charges 16 may be between 30 Hz and 40 Hz. Shock and vibration transmissibility may increase from about 1.33 below resonance to about 2.5 at resonance, in one example configuration.

By using the protection bands, the loading tube 14 becomes better supported within the carrier 12. This increases the resonant frequency range of the loading tube 14 and components inside the loading tube. In one example arrangement, the resonant frequency range for the loading tube 14 may be increased to between 60–70 Hz with the protection bands 18 compared to 20–30 Hz without the protection bands. What this allows is a larger range of vibration frequencies caused by external factors before the loading tube 14 reaches resonance. Test results have also shown that the protection bands 18 serve to reduce transmissibility even if the loading tube 14 is vibrating within its resonant frequency range.

By using protection bands in according with some embodiments, the frequency response and transmissibility of external force loads such as shock and vibration loads have been improved. This protects perforating guns from damage during handling, transportation, and running into a wellbore. As a result, the likelihood of success in operation of perforating guns is increased, which reduces costs and safety concerns associated with pulling mis-fired guns out of a wellbore.

The protection bands according to further embodiments may be used with other types of perforating guns, such as strip guns. A strip gun includes a strip and capsule shaped charges mounted on the strip. To protect a strip gun during handling and transport, the strip gun may be placed in some type of hollow tube or other housing, with the protection bands attached to the outside of the tube as protection.

In other embodiments, protection bands may be used with other types of tools that include explosive components. For example, a packer setting tool may include an explosive used to set a downhole packer.

Figure 5:
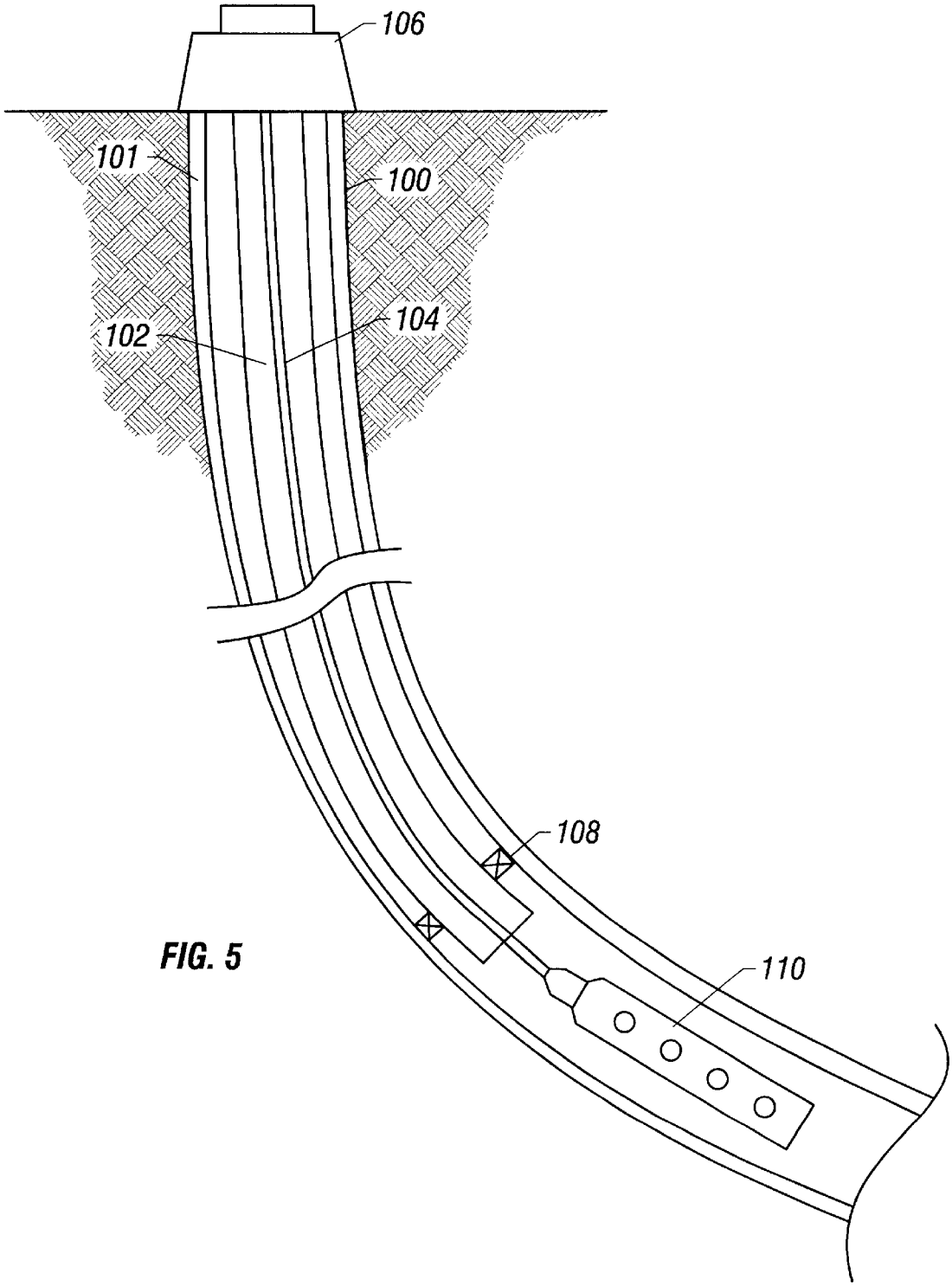
FIG. 5 illustrates an example completion string including a perforating gun string according to one embodiment.

Referring to FIG. 5, an example completion string in a wellbore 101 is illustrated. The wellbore 101 may be lined with casing 100, and a production tubing 102 may be positioned inside the casing 100 to provide a conduit for well fluids. A packer 108 isolates an annular region between the production tubing 102 and the casing 100. A perforating gun string 1 10, which may be lowered on some type of carrier 104 (e.g., wireline, slick line, or coiled tubing) may be lowered through the tubing 102 to a desired depth in the wellbore 101. As the perforating gun string 110 is lowered into the wellbore, it may impact the sides of the tubing 102 and the casing 100, which may subject the perforating gun string to shock loads that may damage internal components of the perforating gun string, such as shaped charges and detonating cords. Protection for these components may be provided by protection bands 18 as discussed above. A well protected gun increases the likelihood of successful firing of shaped charges in the gun.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. An apparatus for use in a wellbore, comprising:

an explosive device;

a housing for the explosive device;

at least one protection barrier mounted on the housing; and a carrier including a chamber to contain the housing, the at least one protection barrier between the housing and the carrier, the at least one protection barrier adapted to reduce transmissibility of an external force load from the carrier to the housing, wherein the wellbore is lined by casing, the carrier being distinct from the casing.

2. The apparatus of claim 1, further comprising a tool adapted to be run into the wellbore, the tool comprising the explosive device, the housing, the at least one protection barrier, and the carrier.

3. The apparatus of claim 1, wherein the explosive device includes one or more shaped charges.

4. The apparatus of claim 1, wherein the explosive device includes a detonating cord.

5. The apparatus of claim 1, wherein the housing includes a loading tube and the explosive device includes one or more shaped charges.

6. The apparatus of claim 1, wherein the at least one protection barrier includes one or more protection bands.

7. The apparatus of claim 1, wherein the at least one protection barrier is formed of a material to absorb shock and vibration loads.

8. The apparatus of claim 1, wherein the at least one protection barrier is formed of a resilient and deformable material.

9. The apparatus of claim 1, wherein the at least one protection barrier includes an elastomeric material.

10. The apparatus of claim 1, wherein the at least one protection barrier includes a tube containing a shock and vibration absorbing material.

11. The apparatus of claim 1, comprising a plurality of protection barrier arranged at predetermined intervals along the housing.

12. The apparatus of claim 1, wherein the external force load includes a shock load.

13. The apparatus of claim 1, wherein the external force load includes a vibration load.

14. The apparatus of claim 2, wherein the tool comprises a perforating gun.

15. The apparatus of claim 2, wherein the wellbore is lined by casing, the tool being distinct from the casing.

16. An apparatus for use in a wellbore, comprising:

an explosive device;

a housing for the explosive device;

at least one protection barrier mounted on the housing;

a carrier including a chamber to contain the housing, the at least one protection barrier between the housing and the carrier, the at least one protection barrier adapted to reduce transmissibility of an external force load from the carrier to the housing; and at least one other protection barrier mounted between the housing and the carrier.

17. The apparatus of claim 16, wherein the protection barriers comprise protection bands arranged around respective portions of the housing.

18. The apparatus of claim 17, wherein the protection bands are arranged along predetermined intervals along the housing.

19. The apparatus of claim 18, wherein each protection band is formed of an elastomeric material.

20. An apparatus for use in a wellbore, comprising:

an explosive device;

a housing in which the explosive device is positioned; and a plurality of protection bands mounted at predetermined intervals along the housing, a carrier providing a chamber.

each of the protection bands comprising an elastomeric material, with the housing placed in the chamber and the protection bands between the carrier and the housing.

21. The apparatus of claim 20, wherein the explosive device comprises one or more shaped charges.

22. The apparatus of claim 20, wherein the housing comprises a loading tube and the explosive device comprises one or more shaped charges mounted in the loading tube.

23. The apparatus of claim 22, further comprising a carrier in which the loading tube is mounted, the protection bands provided between the loading tube and carrier.

* * * * *